US011525101B2

(12) United States Patent
Valla et al.

(10) Patent No.: US 11,525,101 B2
(45) Date of Patent: Dec. 13, 2022

(54) LUBRICANT COMPOSITION FOR INDUSTRIAL GEARING COMING INTO CONTACT WITH FOOD

(71) Applicant: TOTAL MARKETING SERVICES, Puteaux (FR)

(72) Inventors: Marie-Noëlle Valla, Luzinay (FR); Julien Benito, Rive de Gier (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 16/468,566

(22) PCT Filed: Dec. 12, 2017

(86) PCT No.: PCT/EP2017/082363

§ 371 (c)(1),
(2) Date: Jun. 11, 2019

(87) PCT Pub. No.: WO2018/108873

PCT Pub. Date: Jun. 21, 2018

(65) Prior Publication Data

US 2019/0330557 A1 Oct. 31, 2019

(30) Foreign Application Priority Data

Dec. 12, 2016 (FR) ..... 1662312

(51) Int. Cl.

| | |
|---|---|
| ***C10M 169/04*** | (2006.01) |
| ***C10N 20/04*** | (2006.01) |
| ***C10N 30/02*** | (2006.01) |
| ***C10N 30/00*** | (2006.01) |
| ***C10N 40/04*** | (2006.01) |

(52) U.S. Cl.

CPC *C10M 169/041* (2013.01); *C10M 2203/1025* (2013.01); *C10M 2205/026* (2013.01); *C10M 2205/223* (2013.01); *C10M 2209/102* (2013.01); *C10N 2020/04* (2013.01); *C10N 2030/02* (2013.01); *C10N 2030/62* (2020.05); *C10N 2040/04* (2013.01)

(58) Field of Classification Search

CPC ..... C10M 169/041; C10M 2209/102; C10M 2203/1025; C10M 2205/026; C10M 2205/028; C10M 2205/223; C10M 2227/00; C10N 2030/02; C10N 2030/04; C10N 2030/62; C10N 2040/04

See application file for complete search history.

(56) References Cited

U.S. PATENT DOCUMENTS

| | | | | |
|---|---|---|---|---|
| 2,543,964 | A * | 3/1951 | Giammaria | C10M 1/08 508/468 |
| 4,505,834 | A | 3/1985 | Papay et al. | |
| 5,435,928 | A * | 7/1995 | Beck | C10M 145/16 508/468 |
| 5,736,490 | A | 4/1998 | Bouffet et al. | |
| 6,087,308 | A | 7/2000 | Butler et al. | |
| 2008/0234156 | A1 | 9/2008 | Poirier et al. | |
| 2008/0312117 | A1 | 12/2008 | Wallfahrer et al. | |
| 2009/0036546 | A1 | 2/2009 | Shah et al. | |
| 2010/0105583 | A1* | 4/2010 | Garmier | C10M 169/04 508/155 |
| 2014/0364349 | A1 | 12/2014 | Knapton et al. | |
| 2017/0321143 | A1 | 11/2017 | Egersdorfer et al. | |
| 2017/0327760 | A1* | 11/2017 | Egersdorfer | C10M 169/044 |
| 2018/0066200 | A1 | 3/2018 | Scherer | |

FOREIGN PATENT DOCUMENTS

| | | |
|---|---|---|
| CN | 103374451 | 10/2013 |
| WO | WO-2006116775 | 11/2006 |

OTHER PUBLICATIONS

International Search Report for PCT/EP2017/082363, dated Mar. 14, 2018.
Written Opinion of the International Searching Authority for PCT/EP2017/082363, dated Mar. 14, 2018.
Preliminary Search Report for FR 1662312, dated Jul. 31, 2017.
Feng, Yaqing,, Auxiliary Chemistry and Technology, Chemical Industry Press, Jun. 30, 1997, p. 372.

* cited by examiner

*Primary Examiner* — James C Goloboy
(74) *Attorney, Agent, or Firm* — B. Aaron Schulman, Esq.; Stites & Harbison, PLLC

(57) ABSTRACT

The invention relates to a lubricant composition comprising: at least one base oil for coming into contact with food, selected from the groups II, III or V according to the categories defined in the API classification or the equivalents thereof according to the ATIEL classification; at least one hydrogenated polyisobutylene; and at least one ester polymer.

5 Claims, No Drawings

LUBRICANT COMPOSITION FOR INDUSTRIAL GEARING COMING INTO CONTACT WITH FOOD

The present application relates to a lubricant composition, in particular for industrial gearing. The composition advantageously has properties that enable it to be used in applications involving food contact, particularly incidental food contact, and at very low temperatures.

Industrial gearing lubricant compositions used in the food industry must meet the criteria for incidental food contact defined in chapter 21, § 178.3570 ("Lubricants with incidental food contact") of the "Code of Federal Regulation". from the FDA (Food and Drug Administration). Installations in the food industry may also be used in environments with low or very low temperatures, for example at temperatures below −22° C. It is therefore necessary to be able to provide a lubricant composition suitable for incidental food contact and which is versatile in terms of the temperature of use, in particular that may be used at very low temperatures, for example at temperatures below −22° C.

Poly-alpha-olefins (PAO) meet the criteria for incidental food contact and have a pour point that is low enough for use at very low temperatures. However, these compounds are very expensive.

White oils also meet the criteria for incidental food contact. However, their cold properties are not satisfactory. The addition of a pour point depressant (PPD) is therefore necessary. However, to date, only one commercial PPD meets the criteria for incidental food contact.

There is therefore an interest in being able to provide lubricant compositions meeting the food contact criteria and having a pour point sufficiently low for use at low or very low temperatures.

An object of the present invention is to provide lubricant compositions meeting the food contact criteria and having a pour point sufficiently low for use at low or very low temperatures.

It is another object of the present invention to provide such compositions which further exhibit high viscosity, especially at 40° C.

Yet another object of the present invention is to provide such low cost compositions.

Still other objects will become apparent upon reading the description of the invention which follows.

These objectives are achieved by the present invention which relates to a lubricant composition comprising:

- at least one base oil for food contact, chosen from groups II, Ill or V according to the classes defined in the API classification or their equivalents according to the ATIEL classification;
- at least one hydrogenated polyisobutylene;
- at least one ester polymer.

Preferably, the present invention relates to a lubricant composition comprising:

- at least one base oil for food contact, chosen from groups II, Ill or V according to the classes defined in the API classification or their equivalents according to the ATIEL classification;
- at least one hydrogenated polyisobutylene;
- at least one ester polymer chosen from ester copolymers comprising a hydrocarbon backbone, pendant hydrocarbon groups and pendant ester groups.

The base oil according to the invention is not a PAO.

Base oils are defined according to the API classification (or their equivalents according to the ATIEL classification) (Table A).

TABLE A

| | Saturated content | Sulfur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | Poly-alpha-olefins (PAO) | | |
| Group V | Esters and other bases not included in groups I to IV | | |

The base oil according to the invention is chosen from base oils for food contact and in particular for incidental food contact. Criteria for meeting food contact requirements, including incidental food contact, are defined in Chapter 21, § 178.3570 ("Lubricants with Incidental Food Contact") of the FDA's "Code of Federal Regulation". Lubricants meeting the criteria for incidental food contact are certified as NSF H1 (NSF=National Sanitation Foundation).

Preferably, in the composition according to the invention, the base oil is chosen from the group of base oils for food contact chosen from group II according to the classes defined in the API classification or their equivalents according to the ATIEL classification, preferably among the white oils.

White oils are oils well known to those skilled in the art. They correspond to highly refined mineral oils and are therefore of high purity. They have stability properties, including thermal stability, they are chemically inert, they are non-toxic, they are odorless and colorless. White oils are notably defined in the FDA's Code of Federal Regulation (2016) in sections 172.878 and 178.3620. Any type of white oil may be used in the invention. For example, white oils may be chosen from oils of ISO VG15 and ISO VG68 grade. For example, the white oils may be Finavestan A8013® or Finavestan A360B® marketed by Total.

Preferably, hydrogenated polyisobutylene according to the invention is chosen from hydrogenated polyisobutylenes having a number-average molar mass (Mn) between 400 and 2000, preferably between 400 and 1500, for example between 400 and 1300. For example, the hydrogenated polyisobutylenes of the invention may be Indopol H300®, Indopol H25® or Indopol H7® marketed by the company Ineos Oligomers. The hydrogenation of the polyisobutylene may be total or partial.

Preferably, the ester polymer according to the invention is chosen from ester copolymers, preferably from polymers comprising a hydrocarbon backbone, hydrocarbon pendant groups and ester pendant groups. The patent applications EP2014750 and U.S. Pat. No. 2,543,964, incorporated herein by reference, in particular describe ester polymers.

Preferably, the ester polymer is chosen from copolymers of alpha-olefin and polycarboxylic acid esterified with alcohols, preferably dicarboxylic acid, especially α-β-ethylenically unsaturated dicarboxylic acid. The alcohol is especially chosen from linear or branched alcohols comprising from 1 to 10 carbon atoms.

Preferably, the ester polymer is chosen from polymers comprising a hydrocarbon backbone, hydrocarbon pendant groups, for example comprising from 1 to 20 carbon atoms, and ester pendant groups having:

- an average molecular mass (Mw) of between 1000 and 2500, preferably between 1500 and 2500, preferably about 2000, and/or a viscosity at 100° C. (according to ASTM D-445) of between 25 and 45 $mm^2/s$, preferably between 35 and 45 $mm^2/s$, for example approximately 40 $mm^2/s$; and or a pour point (according to ASTM D-97) less than or equal to 0° C., preferably between −10° C. and 0° C., for example between −8 and −2° C.

Preferably, the ester polymer is chosen from copolymers of alpha-olefin and polycarboxylic acid esterified with alcohols, preferably dicarboxylic acid, especially α-β-ethylenically unsaturated dicarboxylic acid, having:

an average molecular mass (Mw) of between 1000 and 2500, preferably between 1500 and 2500, preferably about 2000, and/or a viscosity at 100° C. (according to ASTM D-445) of between 25 and 45 $mm^2/s$, preferably between 35 and 45 $mm^2/s$, for example approximately 40 $mm^2/s$, and/or a pour point (according to ASTM D-97) less than or equal to 0° C., preferably between −10° C. and 0° C., for example between −8 and −2° C.

For example, the ester polymer may be Ketjenlube 240® marketed by Italmatch.

The lubricant composition according to the invention preferably comprises at least 38%, preferably at least 40% by weight of hydrogenated polyisobutylene, preferably at least 45% by weight, preferably between 45 and 60%, more preferably between 45 and 60%. 45 and 55% by weight, based on the total weight of the lubricant composition.

The lubricant composition according to the invention preferably comprises at least 1% by weight of ester polymer, preferably between 1 and 20%, preferably between 2 and 10%, preferably at least 5%, preferably between 5 and 20%, preferably between 5 and 10% by weight, relative to the total weight of lubricant composition.

The lubricant composition according to the invention preferably comprises at least 20% by weight of base oil for food contact, preferably from 20 to 50% by weight, relative to the total weight of the lubricant composition.

The lubricant composition according to the invention may comprise additives. The additives may be any additive known in the field of lubrication, particularly in the field of lubrication of industrial gears. Preferably, the additives are selected from the additives meeting the criteria of food contact, including incidental food contact. The preferred additives for the lubricant composition used according to the invention are chosen from anti-wear additives, extreme pressure additives, viscosity index improvers, anti-corrosion additives, anti-foam agents and antioxidants, and inorganic friction modifiers and mixtures thereof. As for anticorrosive additives, they may be chosen by those skilled in the art depending on the metal to be treated. For example, the anti-corrosion agents of the invention may be chosen from the anti-corrosion agents of aluminum, steel, galvanized steel, yellow metals (for example copper, brass, preferably copper), etc., alone or in mixture.

In a particularly advantageous manner, the lubricant composition according to the invention meets the criteria of food contact, including incidental food contact, as defined above. This allows, in particular, a use of the lubricant composition according to the invention for the lubrication of mechanical systems in agro-food installations, in particular in the lubrication of industrial gearing in the agri-food sector.

In a particularly advantageous manner, the lubricant composition according to the invention has a pour point according to the ISO 3016 standard, lower than −24° C. This allows, in particular, a use of the lubricant composition according to the invention under conditions of very low temperatures, for example below −22° C.

In a particularly advantageous manner, the lubricant composition according to the invention meets the food contact criteria, in particular incidental food contact, as defined above, and a pour point of less than −24° C. This allows, in particular, a use of the lubricant composition according to the invention in the lubrication of mechanical systems in food processing plants at low temperature or very low temperature, for example in cold rooms, freezers, especially in gear lubrication in low-temperature and even very low-temperature food-processing plants, for example in cold rooms, freezers.

The composition according to the invention has a kinematic viscosity at 40° C., measured according to the ISO 3104 standard, of between 500 and 2000 $mm^2/s$. The combination of these high viscosities with a very low pour point advantageously makes it possible to use the lubricant composition according to the invention at low temperatures.

Thus, the lubricant composition according to the invention has a high kinematic viscosity at 40° C. and a very low pour point which allows its versatility and its use under very different temperature conditions.

The present application also relates to the use of a lubricant composition according to the invention for gear lubrication, preferably of industrial gearing, in particular in the field of food processing.

The present application also relates to a gear lubrication method, preferably industrial gearing, particularly in the field of food processing, comprising the implementation of the lubricant composition according to the invention.

The present invention will now be described by way of non-limiting examples.

COMPOUNDS IMPLEMENTED IN THE EXAMPLES

| Component | Chemical nature | Molar mass (Mn) | KV40 ($mm^2/s$) | Pour point (° C.) |
|---|---|---|---|---|
| Finavestan A360B ® | White oil | | 65.80 | −12 |
| Finavestan A80B ® | White oil | | 15.90 | −9 |
| Indopol H300 ® | Hydrogenated polyisobutylene | 1300 | | 4 |
| Ketjenlube 240 ® | Polymer ester | | | −6 |
| Synesstic 5 ® | Synthetic base oil (naphthalene derivative) | | | −33 |
| Indopol H25 ® | Hydrogenated polyisobutylene | 635 | | −22 |
| Indopol H7 ® | Hydrogenated polyisobutylene | 440 | | −34 |
| Lubrizol 3130A ® | Hydrogenated polyisobutylene | | | 3 |
| Irgalube 232 ® | Anti-wear phospho-sulfur | | | |
| antifoam | | | | |
| mixture of antioxidants, anti-wear and anti-corrosion agents | | | | |

The molar mass Mn of the hydrogenated polyisobutadiene is measured by gel permeation chromatography (derived from ASTM D3536).

The kinematic viscosity at 40° C. is measured according to ISO 3104.

The viscosity index is measured according to the ISO 2909 standard.

The pour point is measured according to ISO 3016.

Compositions

Comparative Compositions (White Oil+Hydrogenated Polyisobutadiene)

| | CC1 | CC2 | CC3 |
|---|---|---|---|
| FINAVESTAN A360B | 63.8 | 56.4 | 50.5 |
| INDOPOL H300 | 36.2 | 43.6 | 49.5 |
| Kinematic viscosity at 40° C. ($mm^2/s$) | 470.3 | 690.5 | 1005 |
| Viscosity index | 112 | 115 | 116 |
| Pour point (° C.) | −18 | −21 | −21 |

These lubricant compositions which only include the combination of food contact oil and PIB do not have the expected characteristics in terms of pour point and therefore in terms of resistance at low temperatures.

| | | | | | |
|---|---|---|---|---|---|
| FINAVESTAN A360B ® | 36.6 | 27.3 | | | |
| INDOPOL H300 ® | 51.2 | 50.5 | | | |
| KETJENLUBE 240 ® | 5 | 10 | | | |
| SYNESSTIC 5 ® | 5 | 10 | | | |
| Antioxidant and anticorrosive mixtures | 1.5 | 1.5 | | | |
| IRGALUBE 232 ® | 0.4 | 0.4 | | | |
| antifoam | 0.3 | 0.3 | | | |
| TOTAL | 100 | 100 | | | |
| Kinematic viscosity at 40° C. ($mm^2/s$) | 994.4 | 1003 | | | |
| Viscosity index | 122 | 123 | | | |
| Pour point (° C.) | −24 | −30 | | | |
| FINAVESTAN A360B ® | 46.5 | 46.5 | 45 | 45 | |
| FINAVESTAN A80B ® | | | | | 46.5 |
| INDOPOL H300 ® | 48.5 | | | | 48.5 |
| INDOPOL H1200 ® | | | | | |
| INDOPOL H2100 ® | | | | | |
| LUBRIZOL 3130A ® | | 48.5 | | | |
| INDOPOL H25 ® | | | 50 | | |
| INDOPOL H7 ® | | | | 50 | |
| KETJENLUBE 240 ® | 5 | 5 | 5 | 5 | 5 |
| Pour point (° C.) | −33 | −24 | −24 | −27 | −33 |

These results show that the specific combination of the invention of a incidental food contact oil (excluding PAO) with a PIB and an ester polymer makes it possible to obtain a lubricant composition:

meeting the criteria for incidental food contact;

having a high viscosity;

having a low pour point and therefore good performance at low or very low temperatures.

In a particularly surprising manner, with respect to the compositions CC1, CC2 and CC3, the addition of a relatively high pour point ester polymer makes it possible to greatly reduce the final pour point of the lubricant composition and thus to improve its behavior at low, even very low temperatures.

The invention claimed is:

1. A lubricant composition comprising:

from 20 to 50% by weight of at least one base oil for food contact, wherein said at least one base oil is a white oil;

between 45 and 60% by weight of at least one hydrogenated polyisobutylene having a number average molar mass of between 400 and 1500; and at least 5% by weight and less than or equal to 10% by weight of at least one ester polymer selected from the group consisting of copolymers of alpha-olefin and α-β-ethylenically unsaturated dicarboxylic acid esterified with alcohols, said at least one ester polymer having an average molecular mass (Mw) of between 1500 and 2500, a viscosity at 100° C. determined according to ASTM D-445 of between 25 and 45 $mm^2/s$, and a pour point determined according to ASTM D-97 between −10° C. and 0° C.;

relative to the total weight of the lubricant composition;

wherein the lubricant composition has a kinematic viscosity at 40° C. measured according to ISO 3104 between 500 and 2000 $mm^2/s$.

2. The lubricant composition according to claim 1 having a pour point of less than −24° C.

3. A method of lubrication of gearing comprising placing the lubricating composition according to claim 1 into contact with the gearing being lubricated.

4. The lubricant composition according to claim 1 wherein the at least one ester polymer has a pour point between −8° C. and −0° C.

5. The lubricant composition according to claim 1 wherein the at least one ester polymer has a pour point between −8° C. and −2° C.

* * * * *